US005353970A

United States Patent [19]

Stull et al.

[11] Patent Number: 5,353,970

[45] Date of Patent: Oct. 11, 1994

[54] RIBBON-TYPE DISPENSER CAP

[75] Inventors: Gene Stull, Far Hills; William C. Horwath, Garfield, both of N.J.

[73] Assignee: Stull Closure Technologies, Inc., Randolph, N.J.

[21] Appl. No.: 186,996

[22] Filed: Jan. 27, 1994

[51] Int. Cl.[5] ..... B65D 47/00

[52] U.S. Cl. ..... 222/321

[58] Field of Search ..... 222/519–522, 222/524, 525, 548, 549, 563

[56] References Cited

U.S. PATENT DOCUMENTS

| | | | |
|---|---|---|---|
| 1,799,197 | 4/1931 | Simonek | 222/521 |
| 1,895,854 | 1/1933 | Lipshitz . | |
| 3,108,721 | 10/1963 | Nebinger | 222/394 |
| 3,123,259 | 3/1964 | Musel et al. | 222/521 |
| 3,131,836 | 5/1964 | Van Baarn | 222/521 |
| 3,216,630 | 11/1965 | Stull | 222/499 |
| 3,221,952 | 12/1965 | De See | 222/521 X |
| 3,278,096 | 10/1966 | Miller | 222/521 |
| 3,285,479 | 11/1966 | Porter et al. | 222/521 |
| 3,369,707 | 2/1968 | Porter et al. | 222/83 |
| 3,549,060 | 12/1970 | Smylie | 222/513 |
| 3,578,223 | 5/1971 | Armour | 222/521 |
| 3,901,410 | 8/1975 | Schultz | 222/153 |
| 4,358,031 | 11/1982 | Lohrman | 222/153 |
| 4,646,949 | 3/1987 | Stull | 222/521 |
| 4,754,899 | 7/1988 | Stull | 222/521 |
| 4,842,169 | 6/1989 | Stull | 222/521 |
| 5,044,530 | 9/1991 | Stull | 222/521 |

FOREIGN PATENT DOCUMENTS

| | | |
|---|---|---|
| 1203668 | 10/1965 | Fed. Rep. of Germany . |
| 10767 | of 1909 | United Kingdom . |
| 688732 | 3/1953 | United Kingdom . |

*Primary Examiner*—Kevin P. Shaver

*Attorney, Agent, or Firm*—H. Gibner Lehmann; K. Gibner Lehmann

[57] ABSTRACT

A dispensing cap construction for containers includes a cap body for attachment to a container neck, the cap body having a discharge spout portion, and a closure cap turnably carried by the cap body and overlying the spout portion. The closure cap has a non-round orifice, and a stopper blade located in the closure cap and receivable in the orifice so as to close off the same. Resilient oppositely-disposed spaced-apart support legs are connected with the stopper blade and mount the latter on the spout portion. The resilient legs retain the stopper blade against outward axial movement with respect to the spout portion of the cap body while simultaneously enabling limited rotary movement of the stopper blade with the closure cap as the latter is shifted axially outward on the cap body, to thereby effect removal of the stopper blade from the orifice.

20 Claims, 1 Drawing Sheet

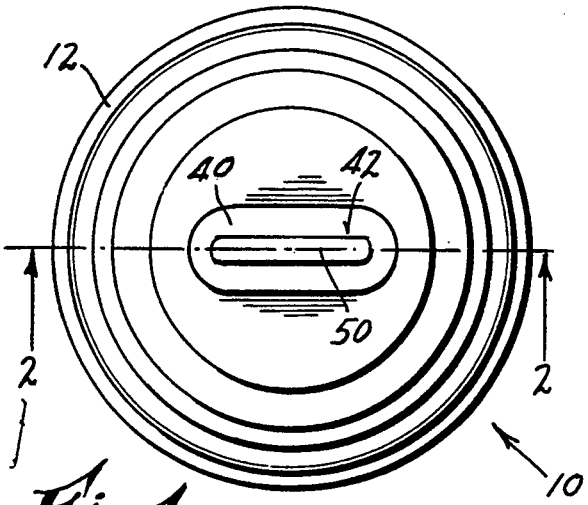
Fig. 1
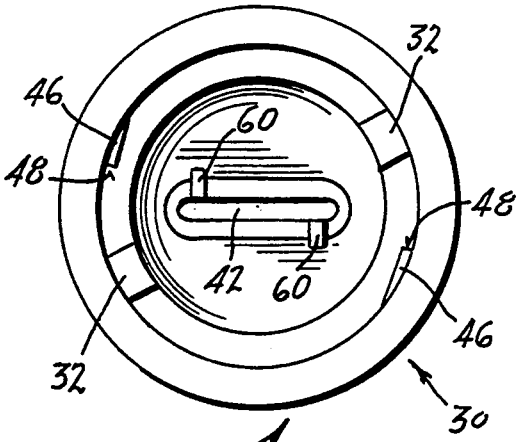
Fig. 3
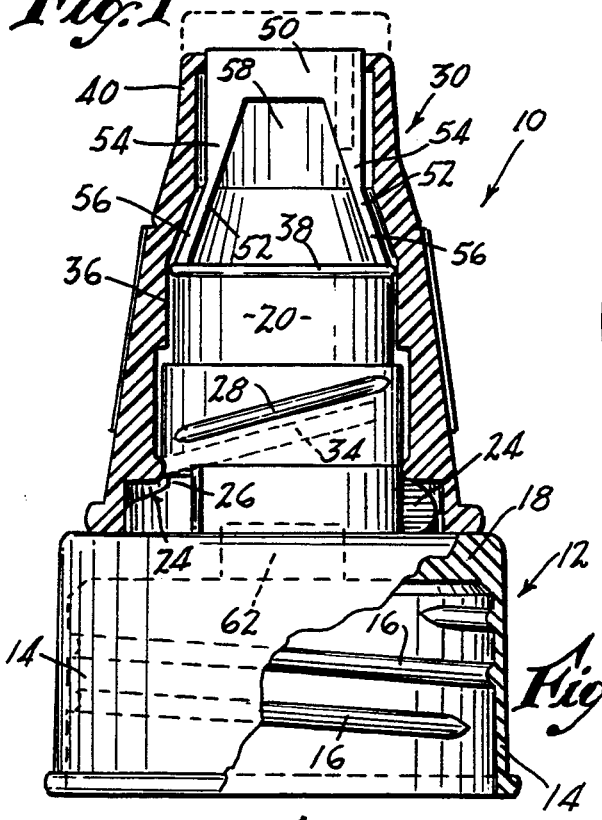
Fig. 2
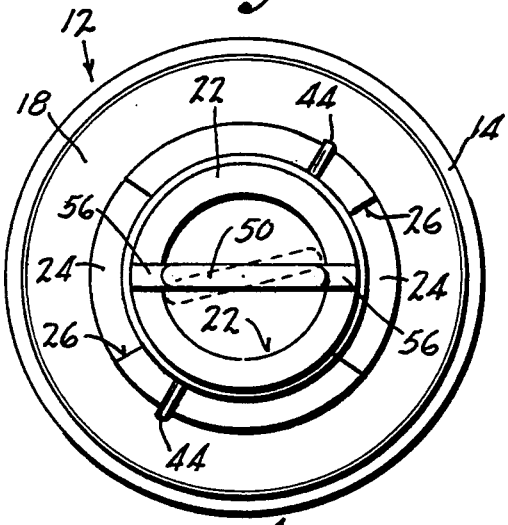
Fig. 4
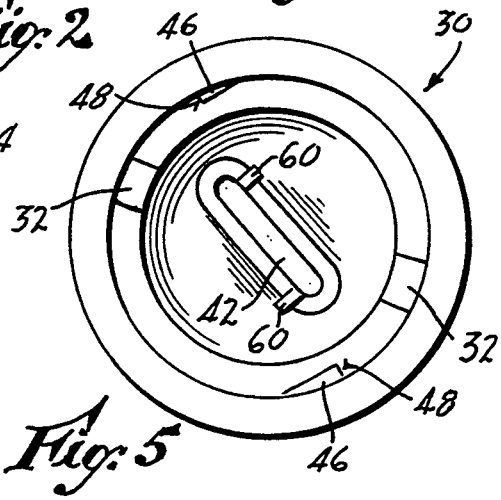
Fig. 5
Fig. 6
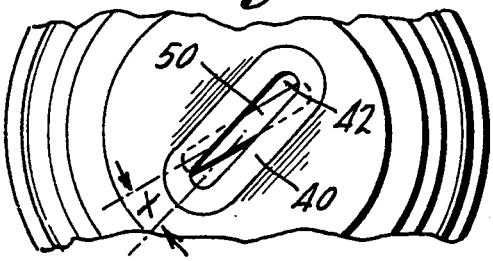

RIBBON-TYPE DISPENSER CAP

Research and development of the present invention and application have not been Federally-sponsored, and no rights are given under any Federal program.

BACKGROUND OF THE INVENTION

1. Field of the Invention

This invention relates to dispenser caps of the type intended to discharge viscous products in ribbon or strip-like form.

2. Description of the Related Art Including Information Disclosed Under 37 CFR §§1.97-1.99

The present invention more particularly relates to improvements in the dispenser cap illustrated and described in U.S. Pat. No. 5,044,530 dated Sep. 3, 1991, and issued to co-inventor Gene Stull.

The following additional U.S. patents are cited as being of interest in the field to which the present invention pertains:

U.S. Pat. Nos.:

| | | |
|---|---|---|
| 1,895,854 | 3,108,721 | 3,216,630 |
| 3,285,479 | 3,369,707 | 3,549,060 |
| 3,578,223 | 3,901,410 | 4,358,031 |
| 4,646,949 | 4,754,899 | 4,842,169 |

Also, reference is made to:

British Pats. Nos. 10,767 and 688,732, and

German Pat. No. 1,203,668

U.S. Pat. No. 1,895,854 discloses a dispenser tube having an apertured cap which is turnable on the tube and wherein an internal plug that is carried on a helical member (29) advances toward or retracts from the aperture as the cap is turned, so as to selectively seal or open the aperture.

U.S. Pat. No. 3,108,721 illustrates a removable valve assembly for a container, having a plug-like valve stem which normally maintains the valve in a closed position. U.S. Pat. Nos. 3,901,410 and 3,549,060 similarly show plug-like tilt valves for selectively sealing off the discharge passages of pressurized aerosol containers.

U.S. Pat. No. 3,578,223 discloses a squeeze bottle having an apertured screw cap and an internal fitment member that is snapped onto and retained by the neck of the bottle. Unscrewing of the cap unseats a sealing peg from the aperture in the cap, to enable dispensing of product.

A somewhat similar construction is shown in U.S. Pat. No. 4,358,031. An apertured screw cap is carried on the neck of a bottle, and an internal fitment member having a sealing plug is receivable in the aperture of the cap.

U.S. Pat. No. 4,646,949 illustrates still another type of screw cap employing a sealing plug that is carried on the base cap or undercap for a dispenser. An aperture in the screw cap is selectively sealed off by the sealing plug when the screw cap is disposed in a lowered, sealing position.

British Patent No. 10,767 discloses an apertured closure cap for the threaded neck of a container, the latter carrying an upstanding stopper plug of flattened configuration. The plug is turnably mounted in a transverse wall that extends across the neck. As the cap is unscrewed, it backs away from the plug thereby to unseal the aperture in the cap.

British Patent No. 688,732 discloses a screw cap construction wherein an axially shiftable apertured closure cap is selectively sealed by a plug that is pressed into the neck of a container and held captive therein. When the cap is unscrewed, the plug is withdrawn from the aperture, enabling discharge of the contents of the container to occur.

German Pat. No. 1,203,668 discloses a twist cap construction employing a stopper peg that is carried by an insert which is force fitted into the neck of a container or tube, and an apertured closure cap that can be moved between sealing and discharging positions. The discharging position corresponds to a raised condition of the closure cap wherein its aperture is uncovered.

Also, U.S. Pat. Nos. 3,216,630; 4,754,899 and 4,842,169 disclose twist cap constructions of the type having stopper pegs of cylindrical configuration. The pegs in each case provide a seal with corresponding cylindrical walls of the discharge openings in the respective twist cap when the latter are placed in sealing positions.

In prior caps having round discharge passages, where the product being dispensed is relatively viscous as in the case of ketchup or mustard, such product emerges in the shape of an elongate, thin bead. In use, the container is inverted and squeezed while the opening of the twist cap is positioned over or applied to the underlying food.

As noted above in connection with U.S. Pat. No. 1,895,854 and British Pat. No. 10,767, efforts have been made to provide cap structures with elongated or oblong openings, in which the product is discharged as a flat ribbon, as opposed to a bead of essentially round or oval cross section. Such a ribbon shape has been considered desirable for use with mustard and ketchup, since it results in a more uniform application, and improved adhesion to the particular food to which such mustard or ketchup is being applied.

However, most prior attempts to achieve ribbon-type discharge characteristics have met with little commercial success. For example, in U.S. Pat. Nos. 3,285,479 and 3,369,707 the twist caps that are disclosed are provided with slit-like openings in their ends, in which are received blade-like sealing members. The blade-like members are fixedly mounted on the undercap or base cap. In U.S. Pat. No. '707, as the twist cap is unscrewed it rides up cam tracks provided on the base cap. The blade-like sealing member occupies the slit in the twist cap. During such unscrewing the upper end portion of the blade-like sealing member is forcibly twisted and deformed, and eventually separates from the walls of the slit to provide a discharge passage for the product. Following use, the consumer reseats the twist cap by turning it in a screwing-on direction, with the blade-like sealing member purportedly being restored to its initial planar shape, and re-establishing its position occupying the slit in the twist cap.

In U.S. Pat. No. 3,285,479 the arrangement is similar, except that the twist cap is not raised by means of a cam track on the base cap. Instead, when the twist cap is turned in either direction, the blade-like sealing member becomes deformed as it is engaged by the inner conical surface of the twist cap and the latter is in turn, cammed upwardly by such engagement. Portions of the walls of the slit become disengaged from the blade-like sealing member and thus enable product discharge. Re-sealing is accomplished by merely pushing downwardly on the twist cap. As this is done, the blade-like sealing member tends to restore the twist cap to its original circumferential position, and the walls of the slit slide over the upper end of the blade-like sealing member, to re-establish the seal.

A number of specific problems have occurred with dispensers of the type involving deformable stopper blades as described above. In particular, it is considered difficult to fabricate a solid sealing member in the form of a flat blade having sufficient resiliency so as to not take a "set", especially following an extended period of use. In addition, attempts to make a plastic blade relatively stiff often resulted in the blade cracking or breaking during use, as opposed to merely flexing, as was desired. In the event of such breakage, the sealing function of the dispenser was completely lost, and there was the possibility of plastic fragments finding their way into the dispensed product. This was particularly troublesome where the substance being discharged was a food such as mustard, ketchup or other creamy substance, such as dressings and the like.

Even where breakage of the blade did not occur, smooth operation of the cap was difficult to attain. In particular, the use of the blade as a cam to shift the cap, as in U.S. Pat. No. '479, caused undue stresses on the blade, and it is believed that the design parameters inherent in prior blade type sealing caps did not lend themselves toward adaptation to a smooth and reliable operating mechanism for a dispensing cap.

As noted above, the present invention involves improvements in the ribbon-type dispenser cap construction of Stull U.S. Pat. No. 5,044,530. While the devices disclosed in this patent have been found to be smooth and reliable in operation, efforts to reduce cost and assembly time are always considered of extreme importance. This patented cap involved basically three separate components, namely the cap body, the closure cap, and as a separate piece, the stopper blade. It was considered that if one component could be eliminated as a separate molded piece, considerable cost savings could be realized. Of course, additional criteria had to be met, namely that any resultant construction have the inherent reliability, safety from contamination, and ease of use of the patented device.

SUMMARY OF THE INVENTION

Accordingly it is an object of the present invention to provide a novel and improved essentially two-piece ribbon-type dispenser cap construction which is extremely simple in its structure and especially low cost in terms of molding, and assembly time.

Yet another object of the invention is to provide an improved dispenser cap construction as above set forth, which provides relatively wide passageways for product flow, thus circumventing potential problems with clogging, poor flow rates for viscous materials, and the like.

Still another object of the invention is to provide an improved dispenser cap as above characterized, which requires a considerably less volume of plastic than many of the prior art devices, thereby saving on material costs.

Yet another object of the invention is to provide an improved dispenser cap in accordance with the foregoing, which is both rugged and reliable in operation, and not susceptible to malfunction.

Still another object of the invention is to provide an improved dispenser cap as outlined above, wherein there is virtually eliminated the possibility of malfunctioning of a type which might result in plastic fragments inadvertently finding their way into the product being dispensed.

A further object of the invention is to provide an improved dispenser cap as above characterized, which can be quickly and inexpensively assembled, largely by automated capping equipment.

The above objects are accomplished by a dispensing cap construction for containers, comprising in combination a cap body and means for attaching the cap body to a container neck, the cap body having a discharge spout portion, and a closure cap turnably carried by the cap body and overlying the spout portion. The closure cap has a non-round orifice, and a stopper blade is located in the closure cap and receivable in the orifice so as to close off the orifice. Resilient means are provided, comprising a pair of oppositely-disposed spaced-apart, resilient support legs connected with the stopper blade and mounting the latter on the spout portion, the resilient means retaining the stopper blade against outward axial movement with respect to the spout portion of the cap body while simultaneously enabling limited rotary movement of the stopper blade with the closure cap as the latter is shifted axially outward on the cap body to thereby effect removal of the stopper blade from the orifice.

The arrangement is such that, in a preferred embodiment, the legs are spaced a sufficient distance so as to permit them to twist or deform slightly as the stopper blade twists with unscrewing movement of the closure cap. It has been found that support legs constructed in accordance with the invention, do not take a "set" to any appreciable extent. Reliable alignment of the stopper blade is maintained at all times, regardless of the open or closed position of the closure cap.

In a preferred form, solely two keying ribs are positioned adjacent the walls of an orifice which is generally oblong or slit-like. The ribs are positioned to guide the blade especially during closing movement of the closure cap, the ribs functioning to engage opposite sides of the blade and insure smooth turning of the blade and alignment with the walls of the orifice.

Other features and advantages will hereinafter appear.

BRIEF DESCRIPTION OF THE DRAWINGS

In the drawings, illustrating a preferred embodiment of the invention:

FIG. 1 is a top plan view of the ribbon-type dispenser cap construction of the present invention, showing the closure cap and stopper blade occupying their closed or sealing positions.

FIG. 2 is a side view, partly in elevation and partly in axial section, taken on the line 2—2 of FIG. 1.

FIG. 3 is a bottom plan view of the closure cap per se, of the dispenser cap construction of FIGS. 1 and 2.

FIG. 4 is a top plan view of the cap body of the dispenser cap construction of FIGS. 1 and 2.

FIG. 5 is a bottom plan view similar to FIG. 3, except showing the closure cap rotated from the position of FIG. 3, as it would appear from the underside, occupying its open, discharging position, and FIG. 6 is a fragmentary top plan view similar to FIG. 1, except showing the closure cap and stopper blade disposed in their open, discharging positions, respectively.

DESCRIPTION OF THE PREFERRED EMBODIMENT

Referring first to FIGS. 1 and 2 there is illustrated a dispenser cap construction generally designated by the numeral 10, including a cap body 12 having a depending skirt 14 with internal threads 16 of usual construction, adapted to mate with corresponding external threads on the neck of a container (not shown). The cap body 12 has a transverse top wall 18, and a spout portion 20 extending upwardly from the top wall 18. The spout portion 20 has a bore or discharge passage 22, Pig. 4, which is preferably of cylindrical configuration. Disposed on the upper surface of the transverse top wall 18 are oppositely disposed cam tracks 24, and at the upper ends of each track 24 there is a stop shoulder 26, one of which is shown in FIG. 2 and both of which are shown in FIG. 4. The spout portion 20 is provided with external threads 28.

Carried on the cap body is a closure cap 30. The closure cap 30 has a pair of cam follower lugs 32 on its underside, FIGS. 3 and 5, adapted to ride up the cam tracks 24 as the closure cap 30 is turned in an unscrewing (counterclockwise) direction as viewed from the top, FIG. 1. The closure cap 30 is provided with internal threads 34 which cooperate with the threads 28 on the spout portion 20, and which function to pull the closure cap 30 axially downward in FIG. 2 when the closure cap 30 is turned in a screwing down direction (clockwise) in FIG. 1.

There is a narrow annular clearance space between the spout portion 20 and the inner surface of the closure cap 30, the clearance space being designated 36. An external sealing bead 38 is provided on the spout portion 20, to prevent the contents of the container from entering the annular space 36. The bead 38 slidingly engages the inner cylindrical surface of the closure cap 30 when the latter is moved between the closed, sealing position illustrated in solid outline in FIG. 2, and the raised, discharging position illustrated in dotted outline, in FIG. 2.

The closure cap 30 has a discharge spout 40 containing a discharge orifice 42. Cooperable means are provided on the exterior surface of the spout portion 20 and on the inner surface of the closure cap 30, to yieldably retain the latter in its open or raised position. In accomplishing the retention, the cap body 12 has a pair of oppositely-disposed outstanding positioning lugs 44, FIG. 4, and there are cooperable camming lugs 46, FIGS. 3 and 5, on the inside of the closure cap 30. When the closure cap 30 is turned in an unscrewing direction, counterclockwise in FIG. 1 or clockwise in either FIG. 3 or FIG. 5, the lugs 44 ride up the camming lugs 46 and come to rest against shoulders 48 which are located at the ends of the camming lugs 46. The lugs 44 are rounded sufficiently so that the shoulders 48 can by-pass the lugs 44 when the user applies sufficient force in a screwing down direction, clockwise as viewed in FIG. 1 or counterclockwise in either FIG. 3 or FIG. 5.

In accordance with the present invention there is provided a novel and improved structural combination for selectively opening or sealing off the discharge orifice 42 of the closure cap 30 in response to turning of the latter with respect to the cap body 12. In accomplishing the sealing function, the the discharge orifice 42 has a non-round, or oblong discharge configuration shown particularly in FIGS. 3, 5 and 6, and there is provided a substantially flat stopper blade 50 having a width in FIG. 2, which exceeds its height in this figure. Disposed at opposite ends of the blade 50 are depending, divergent, resilient and yieldable support legs 52, which extend to the periphery of the bore 22 of the spout portion 20. The legs 52 are relatively thin, being of a thickness which is commensurate with the thickness of the stopper blade 50. The legs are flexible and stretchable in a direction transverse to their lengths. Each leg 52 has two portions, an upper portion 54 whose outermost surface is generally parallel to the axis of the closure cap 30, and a lower portion 56 which is convergent toward the axis of the closure cap 30 and which is of reduced cross section with respect to that of the upper portion 54. The innermost edges of each leg are convergent as shown, and together with the stopper blade 50 and the lip of the spout portion 20, form a trapezoidal-shaped opening 58 when viewed from the side, FIG. 2, which provides a relatively large clearance space through which product being discharged can flow.

As shown in FIGS. 2 and 4, the innermost edges of the legs 52 merge into the cylindrical wall of the bore 22 of the spout portion 20, being substantially flush therewith.

Further in accordance with the present invention, there are provided novel vertical guide ribs 60 on the underside of the closure cap 30 and adjacent the discharge orifice 42 thereof, the guide ribs 60 being substantially co-extensive with one another. One rib 60 is disposed on a side wall of the orifice 42 and nearer one end thereof, whereas the other rib 60 is disposed on the other side wall of the orifice 42 and nearer the other end thereof.

The guide ribs 60 engage the opposite faces of the stopper blade 50 when the closure cap 30 is disposed in its lowered, sealing position as shown in FIG. 1, and as shown in solid outline in FIG. 2. When the closure cap 30 is turned in an unscrewing direction, counterclockwise in FIG. 1, the walls of the discharge orifice 42, having been in engagement with the stopper blade 50, cause it to turn initially only, with the closure cap 30. The absence of ribs on the opposite wall of the discharge orifice 42 directly across from each rib 60 enables the closure cap to ultimately turn by a greater extent than the stopper blade 50 immediately after the initial unscrewing movement has occurred, thereby requiring less turning of the blade 50 than would otherwise be the case were the blade 50 keyed to the closure cap 30 more or less continuously as in the constructions disclosed in Stull U.S. Pat. No. 5,044,530 above identified. As a consequence, the stopper blade 50 turns through an angle which is less than that ultimately experienced by the closure cap 30, such that the parts eventually assume the relative positions shown in FIG. 6. Stated differently, in a fully unscrewed or open position of the closure cap 30, wherein the cam lugs 32 engage the stop shoulders 26, the closure cap 30 and its orifice 42 have turned through a greater angle than the stopper blade 50, by an amount indicated by the angle "X" in FIG. 6. FIG. 4 shows in dotted outline, the position of the stopper blade 50 when twisted, corresponding to a discharging condition of the dispenser cap wherein the closure cap 30 has been raised to the dotted outline position in FIG. 2.

The effect of the reduced turning required on the part of the stopper blade 50 has been found to contribute significantly to the successful operation of the dispenser cap construction 10. In particular, the amount of flexing of the support legs 52 that is required as occasioned by the turning of the stopper blade 50, is correspondingly reduced. The reduction in flexure has two important advantages. It markedly increases the reliability of the dispenser cap since the legs 52 are not likely to break from repeated, excessive stretching. Second, the reduced flexure minimizes the tendency for the legs 52 to take a "set", as was often the case in prior devices where a plastic component was subjected to repeated stretching or prolonged elastic deformation to a predetermined state or configuration. As a consequence, reliability has been found to be excellent, with no noticeable tendency for the legs 52 to buckle or bend, or otherwise experience any tendency to fail.

The particular arrangement of the ribs 60 has been found to contribute to the proper guidance of the stopper blade 50 when the closure cap 30 is turned toward a closing position. Because each rib 60 has no counterpart (rib) on the opposite wall of the discharge orifice 42, there is realized increased space between the stopper blade 50 and the walls of the discharge orifice 42, through which product can more easily flow.

Also, with the disclosed construction, the inclusion of the lugs 44, 46 has been found to be desirable from the standpoint of eliminating any tendency for the resilience of the support legs 52 acting through the stopper blade 50, to inadvertently cause backing off (i.e. toward closing) of the closure cap 30 from its fully open position.

In a preferred form of the invention, there is provided on the underside of the cap body, a keying recess designated 62 in FIG. 2, by which the cap body 12 can be oriented to a particular rotary position on suitable automatic capping equipment (not shown). This same capping equipment can utilize the oblong configuration of the closure cap orifice 42 during assembly, so that the closure cap 30 can be pressed onto the cap body 12 in the proper manner and without the need for manual positioning or guidance. During such pressing on, the threads 28 and 34 by-pass one another, in a manner known per se in the dispenser cap art.

From the above it can be seen that we have provided a novel and improved dispenser cap construction which is both simple in its structure, being in a preferred form, constituted of only two separate molded components, and reliable in operation. Relatively high flow rates are achievable by the unique disposition and configuration of the guide ribs 60, without sacrifice of reliability in assuring alignment between the stopper blade 50 and the walls of the discharge orifice 42 as the closure cap is closed.

The arrangement of two support legs 52 for the stopper blade has been found to provide the needed support therefor while still enabling the blade to turn a limited extent with initial unscrewing movement of the closure cap. Potential problems with the legs 52 taking a "set", or with inadvertent breakage of the legs from repeated opening and closing, are considered to be completely overcome. Also, by virtue of the relatively small mass or volume of plastic represented by the thin stopper blade 50 and support lugs 52, there is realized a savings in the amount of plastic material required, and a consequent savings in manufacturing expense. Also, the impact on the environment is lessened, because of the reduced bulk represented by the article after it has been discarded.

Finally, the dispenser cap of the invention can be adapted for use not only with foods as noted above, but also with other viscous substances, including chemicals, specifically adhesives or glues.

The disclosed ribbon-type dispenser cap construction is thus seen to represent a distinct advance and improvement in the field of closures for hand-held dispensers.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A dispensing cap construction for containers, comprising in combination:

a) a cap body and means for attaching the cap body to a container neck, said cap body having a discharge spout portion, b) a closure cap turnably carried by the cap body and overlying said spout portion, c) said closure cap having a non-round orifice, d) a stopper blade located in said closure cap and receivable in said orifice to close off said orifice, and e) resilient means comprising a pair of oppositely-disposed spaced-apart, resilient support legs connected with said stopper blade and mounting the latter on the spout portion, said means retaining the stopper blade against outward axial movement with respect to the spout portion of the cap body while simultaneously enabling limited rotary movement of the stopper blade with the closure cap as the latter is shifted axially outward on the cap body to thereby raise the orifice from the stopper blade.

2. The invention as set forth in claim 1, wherein:

a) said support legs are integrally formed with said stopper blade.

3. The invention as set forth in claim 1, wherein:

a) said support legs are integrally molded with said discharge spout portion.

4. The invention as set forth in claim 1, wherein:

a) said support legs are characterized by a thickness which is commensurate with that of the stopper blade.

5. The invention as set forth in claim 1, wherein:

a) said orifice has elongate oppositely facing side walls, and b) solely one positioning rib disposed at one end of one side wall, and c) solely one positioning rib disposed at one end of the other side wall, inner surfaces of said ribs being substantially coincident with the respective side walls.

6. The invention as set forth in claim 5, wherein:

a) said closure cap is moveable on said cap body between an open, discharging position and a closed, sealing position, b) said ribs normally engaging opposite faces respectively of said stopper blade when the closure cap is disposed in its closed, sealing position, and becoming disengaged from said stopper blade when the closure cap is moved toward its open, discharging position.

7. The invention as set forth in claim 1, wherein:

a) said closure cap and cap body have an annular clearance space therebetween, and a) cooperable sealing means on said cap body and closure cap, for blocking product from leakage into said annular clearance space.

8. The invention as set forth in claim 1, and further including:

a) an upwardly facing cam track on said cap body, b) said closure cap having a cam lug adapted to ride up said cam track and thus raise the closure cap in response to turning thereof.

9. The invention as set forth in claim 8, wherein:

a) said closure cap is moveable on said cap body between an open, discharging position and a closed, sealing position, b) said cap body having an outwardly facing positioning rib on its spout portion, c) said closure cap having a cooper able camming shoulder on its inner surface, said camming shoulder being engageable with said outwardly facing rib, to maintain the closure cap in its open, discharging position against the force of said resilient support legs.

10. The invention as set forth in claim 1, wherein:

a) said stopper blade has a generally rectangular configuration, and having a width that is in excess of its height measured axially of the cap body, b) said support legs being connected to the blade at the ends of the rectangular configuration.

11. The invention as set forth in claim 10, wherein:

a) said support legs each have a first portion which has an outer edge that is substantially axially aligned with the axis of the cap body, and b) a second portion which is convergent upwardly with respect to the axis of the cap body.

12. The invention as set forth in claim 11, wherein:

a) said second portion of each leg being of reduced cross sectional configuration with respect to that of the said first portion of each leg.

13. The invention as set forth in claim 1, wherein:

a) said support legs have a tapered configuration and are of reduced dimension adjacent their points of attachment respectively, to said spout portion.

14. The invention as set forth in claim 1, wherein:

a) said stopper blade and support legs, together with the spout portion of the cap body, form a substantially trapezoidal opening when viewed from the side of the cap body.

15. The invention as set forth in claim 1, wherein:

a) said cap body has a keying notch in its underside, the walls of said keying notch being adapted for engagement by automatic capping equipment so as to permit precise positioning of the cap body with respect to the closure cap when the latter is assembled to the cap body.

16. The invention as set forth in claim 1, wherein:

a) said resilient support legs yield circumferentially in response to initial turning of the closure cap on the cap body.

17. The invention as set forth in claim 1, wherein:

a) said spout portion has a discharge bore forming an inner wall surface, b) said support legs merging into said wall surface at their respective points of attachment to the spout portion, so as to avoid interference, by said legs, with product flowing past the inner wall surface of said spout portion.

18. The invention as set forth in claim 1, wherein:

a) said resilient support legs are each of a length which exceeds the height of the stopper blade, measured in a direction axially of the cap body.

19. The invention as set forth in claim 1, wherein:

a) said resilient support legs are each of a length which is at least twice the height of the stopper blade, measured in a direction axially of the cap body.

20. The invention as set forth in claim 17, wherein:

a) said resilient support legs, at their respective points of attachment to the spout portion, are spaced from one another by a distance which exceeds the width of the stopper blade, measured transversely to the axis of the cap body.

* * * * *